United States Patent [19]

Eckold et al.

[11] 4,060,046

[45] Nov. 29, 1977

[54] HAND TOOL

[76] Inventors: Gerd-Jurgen Eckold, Silberhutte 11, D 3424 St. Andreasberg; Hans Maass, Germelmannstr. 12, D 3422 Bad Lauterberg, both of Germany

[21] Appl. No.: 653,883

[22] Filed: Jan. 30, 1976

[51] Int. Cl.[2] ..... B21D 19/02; B21D 39/02

[52] U.S. Cl. ..... 113/54 R; 29/243.58

[58] Field of Search ..... 113/54 R, 54 A, 55, 113/56, 57; 29/243.58

[56] References Cited

U.S. PATENT DOCUMENTS

| | | | |
|---|---|---|---|
| 2,810,420 | 10/1957 | Gibson | 113/54 X |
| 2,944,503 | 7/1960 | Wilson et al. | 113/54 |
| 3,421,356 | 1/1969 | Buske | 29/243.58 X |
| 3,477,272 | 11/1969 | Hunter | 113/54 X |
| 3,602,032 | 8/1971 | Skintzis | 113/54 X |
| 3,877,286 | 4/1975 | Fontaine et al. | 113/54 X |

FOREIGN PATENT DOCUMENTS

| | | | |
|---|---|---|---|
| 804,926 | 5/1951 | Germany | 113/54 |

*Primary Examiner*—Willie G. Abercrombie
*Assistant Examiner*—Horace M. Culver
*Attorney, Agent, or Firm*—Watson, Cole, Grindle & Watson

[57] ABSTRACT

A power-operable hand tool for folding back upright flange portions at the edges of sheet material, which comprises a jaw for supporting the underside of the sheet during said folding operation, an operating jaw pivotally mounted about an axis extending parallel to the axis of the support jaw drive means for causing operative pivoting of said operative jaw, said drive means being connectable to a source of motive power therefor, wherein the operative jaw is formed at one end with a recessed portion terminating at its periphery in a lug portion capable of engaging over the edge of an upright flange portion to be folded back, a main pressing surface extending from said recessed portion.

13 Claims, 4 Drawing Figures

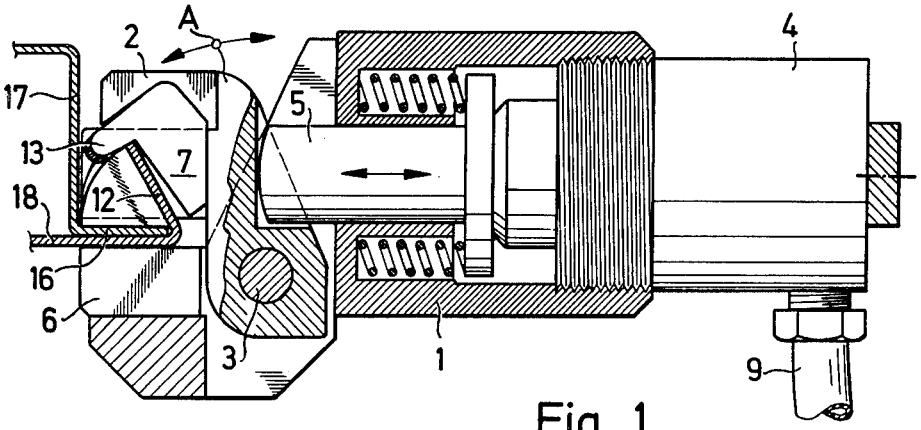
Fig. 1
Fig. 2
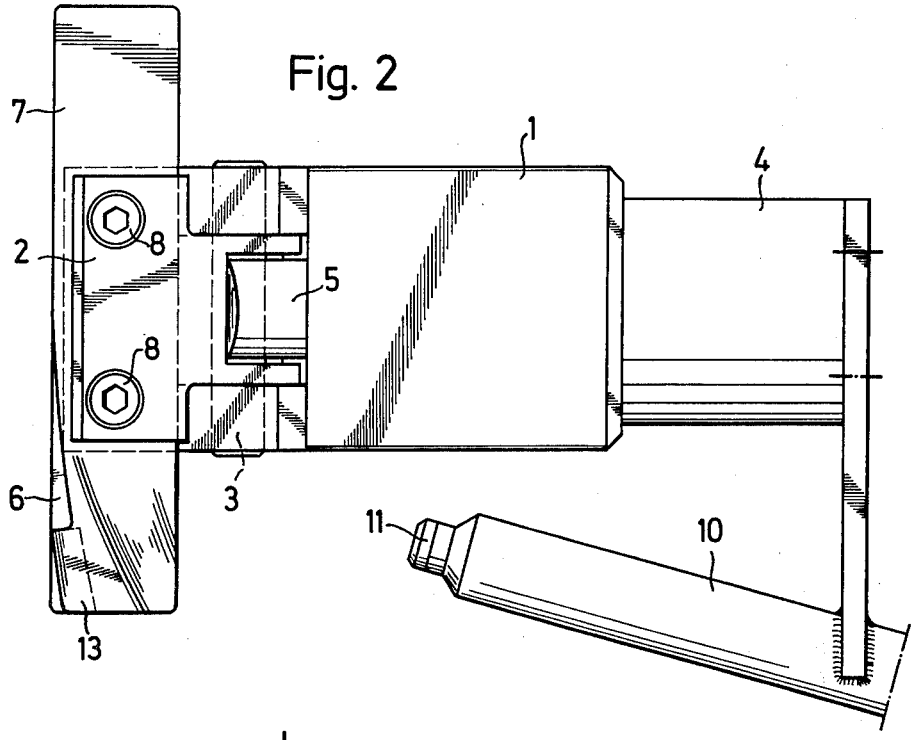
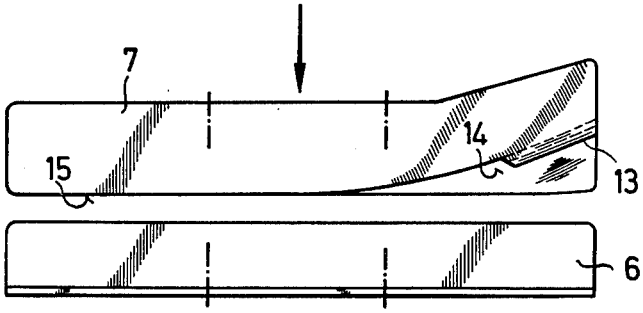
Fig. 3

HAND TOOL

This invention relates to a power-operable hand tool for folding back upright flange portions at the edges of metal or other tough sheet material. Normally, such upright flange portions will extend initially substantially at right angles to the remainder of the sheet.

As is known, metal sheets in doors, ceilings and other structures are commonly joined together by folding back the edges. This folding back operation has hitherto been carried out with roller machines, presses or by knocking round by hand. Also, electromotively and pneumatically operated hand tools are known for pressing together sheet metal edge portions that are already folded back at an acute angle.

Beating sheets together by hand is strenuous, time-consuming and very noisy. If roller machines and presses are used, the parts to be worked, which are often very bulky and heavy, have to be carried to the machine.

It is an object of the invention to provide a mobile device with which sheet metal edges can be folded back on site so that it is no longer necessary to use the expensive roller machines and presses or to beat round by hand the upright sheet metal edges in order to fold them back.

The invention provides a power-operable hand tool for folding back upright flange portions at the edges of sheet material, which comprises a jaw for supporting the underside of the sheet during said folding operation, an operating jaw pivotally mounted about an axis extending parallel to the axis of the support jaw, drive means for causing operative pivoting of said operative jaw, said drive means being connectable to a source of motive power therefor, wherein the operative jaw is formed at one end with a recessed portion terminating at its periphery in a lug portion capable of engaging over the edge of an upright flange portion to be folded back, the main pressing surface extending from said recessed portion.

Hand tools made according to the invention have the advantage that as a result of the special shaping of the operative jaw, upright sheet metal edges standing substantially at right angles can be folded back in one operation by moving the tool, operating with a continuous stroke sequence, along the edges.

One form of hand tool according to the invention has a grip housing, a stationary support jaw and a swivel operating jaw being arranged at one end thereof and a drive push rod for the operative jaw, arranged for automatic or manually-controlled stroke sequence, being accommodated at the other end. The grip housing is preferably so designed that it permits the operative and/or support jaw to be changed to suit the different thickness of the sheet metal and the fold shapes. The hand tool can be operated electrically, hydraulically or pneumatically.

The operative jaw preferably includes an intermediate folding-back portion between said recessed portion and the main pressing surface. Said intermediate portion preferably has curved or inclined planar operating surfaces to suit its folding function.

Although the shaping of the recessed portion may itself suffice to define the said lug portion, the lug may instead project downwardly beyond the outer rectilinear edge of the operating jaw.

A hand tool according to the invention may comprise a longitudinally extending supporting jaw for lying flat against the underside of the sheet metal and an operative jaw extending parallel thereto and drivable in a swivel movement about an axis parallel to the longitudinal axes of the jaws, wherein there is provided on one end of the operative jaw, on the pressing surface facing the pressing surface of the supporting jaw, a recess for forming a lug that engages in the manner of a hook over an upright sheet metal edge, and adjoining this lug there is provided a curved or inclined folding back portion which continues into the plane pressing surface of the operative jaw.

One form of hand tool according to the invention will now be described, by way of example, with reference to the accompanying drawings, in which:

FIG. 1 is a diagrammatic view of the hand tool, partly in longitudinal section;

FIG. 2 is a plan view of the tool;

FIG. 3 is a front view of the pressing jaws; and

Figure 4:
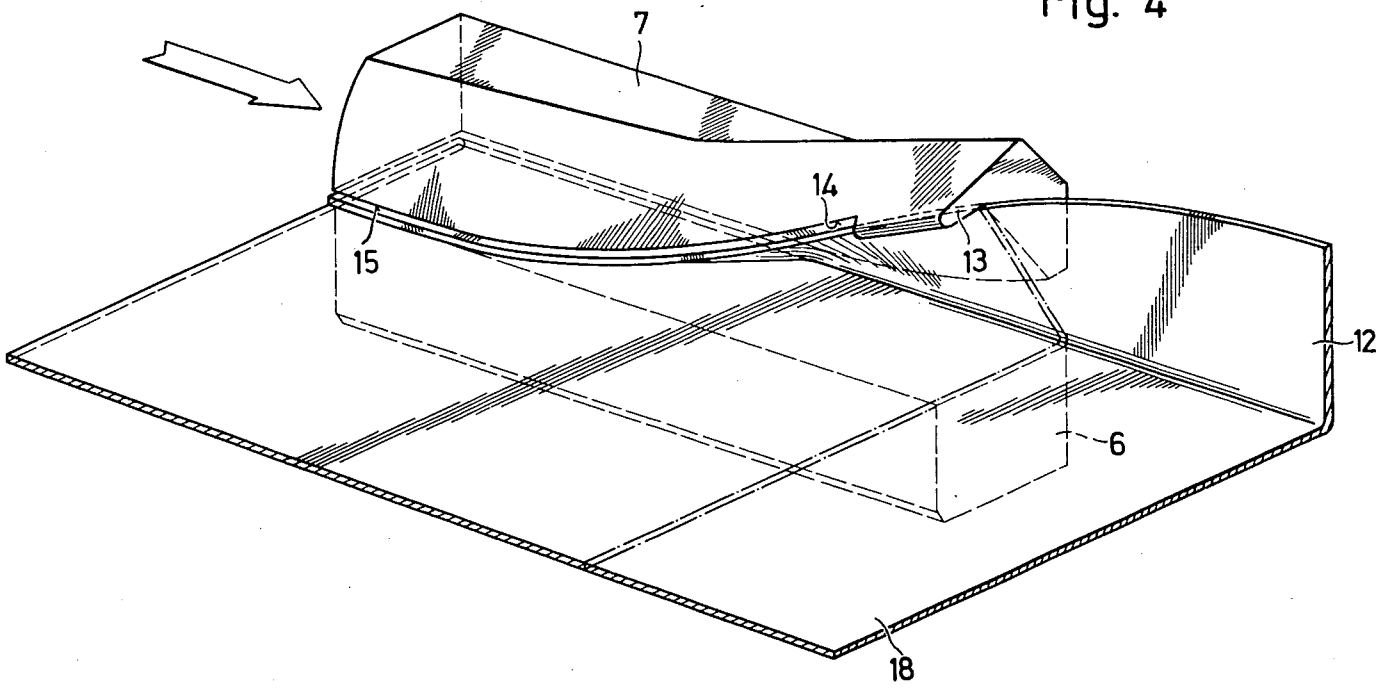
FIG. 4 is a diagrammatic perspective view showing the hand tool in operation.

Referring to the drawings, the hand tool has a grip housing 1, at the front of which an angled lever 2 is mounted for rotation about an axis 3, and at the rear of which is a screw-mounted high-pressure hydraulic cylinder 4. The piston stroke of the hydraulic cylinder 4 is transferred to the angular lever 2 by means of a drive push rod 5. A stationary supporting jaw 6 and an operative jaw 7, which is pivotable back and forth in the direction of the arrow A (FIG. 1), are secured to the housing 1 and the angular lever 2 respectively each by means of two screws. The set screws for the operative jaw 7 are indicated by 8 in FIG. 2. By means of a high pressure tube 9, the hand tool is connected to a hydraulic power source which is not shown. Accommodated in the hand grip 10 is an electroswitch 11 for activating an individual or continuous stroke of the operative jaw 7.

The method of operation of the described hand tool is as follows: The tool is held in both hands (on the housing and on the hand grip 10) and advanced to the sheet metal edge 12 that is to be folded back. When the switch 11 is pressed, the hydraulic cylinder 4 is actuated, and the operative jaw 7 is thereby pivoted towards the upright sheet metal edge 12 to be folded back. The folding process is started by the lug 13 on the leading end of the hand tool, which engages over the sheet metal edge while still vertical. The recessed portion next to the lug 13 and the immediately adjacent supplementary folding-back portion 14 (see FIG. 4) have the effect, on pivoting of the jaw 7, of folding back the raised edge 12 in the desired direction. The sheet metal edge 12 is then folded back parallel to the sheet 18 (FIG. 4), or against a folded edge 16 of a fastening sheet 17 (FIG. 1), by means of the following plane section 15 of the operative jaw. Thus, the folding back of the sheet metal edge is initiated by the lug 13, and is completed by the following flat pressing surface 15 of the jaw 7.

Depending on the shape of the jaws it is possible also to produce round or curved folded joints in essentially the same manner.

We claim:

1. A power-operable hand tool for folding back upright flange portions at the edges of sheet material, which comprises a support jaw having a main pressing surface for supporting the underside of the sheet material during said folding, an operative jaw pivotally mounted about an axis extending parallel to the main pressing surface of the support jaw, drive means for causing operative pivoting of said operative jaw, said drive means being connectable to a source of motive power therefor, wherein the operative jaw includes a main pressing surface portion at one end of the operative jaw and a recessed surface portion at the other end of the jaw, the recessed surface portion having at its periphery a lug portion capable of engaging over the edge of the upright flange portion to be folded back.

2. A hand tool according to claim 1, wherein said drive means includes a drive rod mounted in a grip housing.

3. A hand tool according to claim 2, which includes means for enabling said drive rod to be operated in a manually or automatically controlled sequence.

4. A hand tool according to claim 1, wherein the drive means is operable by fluid under pressure.

5. A hand tool according to claim 1, wherein at least one of the jaws is exchangeable.

6. A hand tool according to claim 1, wherein the main pressing surfaces of the jaws are planar.

7. A hand tool according to claim 1, wherein the operative jaw includes an intermediate folding-back surface portion between said recessed surface portion and the main pressing surface portion.

8. A hand tool according to claim 7, wherein said intermediate portion has curved planar operating surfaces.

9. A hand tool according to claim 1, wherein the lug portion projects downwardly beyond a outer rectilinear edge of the operating jaw.

10. A hand tool according to claim 7, wherein said intermediate portion has inclined operating surfaces.

11. A power-operable hand tool for folding back upright sheet metal flanges and edges disposed substantially at right angles to a sheet, comprising a longitudinally extending supporting jaw having a planar pressing surface for lying flat against the underside of the sheet and an operative jaw having a pressing surface including a planar pressing surface portion, a recess portion forming a lug for engaging in the manner of a hook over an upright sheet metal edge, and a folding back surface portion adjacent to the lug and continuing into the planar pressing surface portion; the operative jaw drivable in a swivel movement about an axis such that the planar pressing surface of the supporting jaw and the planar pressing surface portion of the operative jaw can become approximately coplanar.

12. A hand tool according to claim 11, wherein the folding back portion is curved.

13. A hand tool according to claim 11, wherein the folding back portion is inclined.

* * * * *